US005579834A

United States Patent [19]

Chiba

[11] Patent Number: 5,579,834

[45] Date of Patent: Dec. 3, 1996

[54] HEAT EXCHANGER

[75] Inventor: Tomohiro Chiba, Isesaki, Japan

[73] Assignee: Sanden Corporation, Gunma, Japan

[21] Appl. No.: 520,275

[22] Filed: Aug. 28, 1995

Related U.S. Application Data

[63] Continuation of Ser. No. 233,400, Apr. 26, 1994, abandoned.

[30] Foreign Application Priority Data

Apr. 26, 1993 [JP] Japan ..... 5-021876 U

[51] Int. Cl.[6] ..... F28F 9/04

[52] U.S. Cl. ..... 165/173; 165/76; 165/176; 165/DIG. 476; 29/890.043

[58] Field of Search ..... 165/76, 151, 153, 165/173, 175, 176; 29/890.043

[56] References Cited

U.S. PATENT DOCUMENTS

| | | | |
|---|---|---|---|
| 1,561,212 | 11/1925 | Britton | 165/153 |
| 1,911,375 | 5/1933 | Lucke | 165/176 |
| 2,158,792 | 5/1939 | Erbach | 165/174 |
| 2,225,760 | 12/1940 | Wynn | 165/176 |
| 3,265,126 | 8/1966 | Donaldson | 165/153 |
| 4,153,305 | 5/1985 | Hagemeister | 228/178.2 |
| 4,347,966 | 9/1982 | Feutrel | 29/890.043 X |
| 4,860,823 | 8/1989 | Noguchi | 165/153 |
| 5,046,555 | 9/1991 | Nguyen | 165/173 |
| 5,094,293 | 3/1992 | Shinmura | 165/178 |
| 5,211,222 | 5/1993 | Shinmura | 165/176 |

FOREIGN PATENT DOCUMENTS

| | | | |
|---|---|---|---|
| 646612 | 11/1928 | France | 165/175 |
| 1097396 | 7/1955 | France | 165/173 |
| 803998 | 2/1951 | Germany | 165/176 |
| 1143525 | 2/1963 | Germany | 29/890.052 |
| 1807464 | 7/1970 | Germany . | |
| 2306999 | 2/1972 | Germany . | |
| 1256228 | 12/1971 | United Kingdom . | |

*Primary Examiner*—Leonard R. Leo
*Attorney, Agent, or Firm*—Baker & Botts, L.L.P.

[57] ABSTRACT

A heat exchanger includes a pair of tanks spaced from each other and a plurality of parallel heat transfer tubes fluidly connected between the pair of tanks. Each tube has end portions inserted into holes disposed in the tanks. The end portions of each tube have a maximum diameter which is smaller than a central diameter of a central portion of the tube. At least one of the end portions comprises a straight portion having the maximum diameter and a tapered portion extending from the straight portion with a tapering diameter gradually decreasing from the maximum diameter. Manufacturing this heat exchanger is easier because the tubes are easily inserted into the holes of the tanks. Further, effective brazing between the tubes and the tanks may be achieved by the structure of the tube end portions having the straight portions and the tapered portions even if the length of the tubes vary slightly due to warping or improper manufacture.

22 Claims, 6 Drawing Sheets

HEAT EXCHANGER

This application is a continuation of application Ser. No. 08/233,400, filed Apr. 26, 1994, now abandoned.

BACKGROUND OF THE INVENTION

1. Field of the Invention

The present invention relates to a heat exchanger suitable for use in an air conditioning system for vehicles, and more particularly to improved end portions for heat transfer tubes in heat exchangers.

2. Description of the Related Art

FIGS. 5–7 depict a conventional heat exchanger for use in an air conditioning system for vehicles. In FIGS. 5 and 6, a heat exchanger 21 comprises a pair of tanks 22 and 23. Inlet pipe 24 and outlet pipe 25 are connected to tank 22. A plurality of heat transfer tubes 26 (for example, refrigerant tubes) are fluidly connected between tanks 22 and 23. Each tube 26 has a central portion 26*a* and end portions 26*b* having diameters which are smaller than the diameter of central portion 26*a*. End portions 26*b* are inserted into holes 22*a* and 23*a* disposed in tanks 22 and 23, respectively, and fixed to tanks 22 and 23 by brazing. A partition 27 is provided in tank 22 at a center portion thereof. A heat medium, for example, refrigerant, flows from inlet pipe 24 to outlet pipe 25 through the interior of tank 22, down heat transfer tubes 26, through the interior of tank 23, up heat transfer tubes 26 and through the interior of tank 22, as shown by arrows in FIG. 6.

FIG. 7 depicts the structure of the connection between end portion 26*b* of each heat transfer tube 26 and tank 22 or 23. End portion 26*b* extends straight through tank 22 (23) and has a substantially uniform diameter which is smaller than the diameter of central portion 26*a*. End portion 26*b* is inserted through hole 22*a* (23*a*) and fixed to tank 22 (23) by brazing, welding, gluing or the like between the periphery of end portion 26*b* and the inner edge of hole 22*a* (23*a*). Gap A between the periphery of end portion 26*b* and the inner edge of hole 22*a* (23*a*) generally has a relatively small width, for example, not more than about 0.2 mm (0.008 in), so that a sufficiently thick layer of brazing material may be extended to uniformly cover end portion 26*b*. Other connecting methods such as gluing or welding may also be used. In such a case, the width of gap A is also relatively small, for example, not more than about 0.2 mm (0.008 in). Specifically, if the width of gap A is greater than about 0.2 mm (0.008 in), it is difficult to provide a sufficient amount of brazing material in the gap to enable proper brazing to occur.

Providing end portions 26*b* as straight portions, however, presents difficulties in the manufacturing of the heat exchanger. Because the end portions 26*b* are straight and have a diameter which is only slightly less than the diameter of the holes, it is not easy to insert end portions 26*b* into holes 22*a* and 23*a*. Therefore, this type of heat transfer tube does not permit easy assembly of the heat exchanger.

To solve such problems, another structure for end portions of heat transfer tubes shown in FIG. 8 has been designed. In this structure, a heat transfer tube 31 comprises a central portion 31*a* and end portions 31*b*. Each end portion 31*b* is tapered from central portion 31*a*, so that the diameter of end portion 31*b* gradually decreases from a maximum diameter at a base 32 to a minimum diameter at a tip 33. The width of gap A between base 32 and the inner edge of hole 22*a* (23*a*) of tank 22 (23) is equal not more than about 0.2 mm (0.008 in). In such a structure, because end portions 31*b* are tapered, they may be more easily inserted into holes 22*a* (23*a*). Therefore, this type of heat transfer tube permits easier assembly of the heat exchangers.

In manufacturing this type of heat exchanger, however, sometimes central portion 31*a* is not long enough to properly position end portion 31*b* for brazing, as shown in FIG. 9. This problem often occurs because of warping of tube 31 or nonuniformity of the length of tubes 31 in the direction of the y-axis depicted in FIGS. 6 and 9. When using tubes 31, as shown in FIG. 9, the width of gap A is enlarged by the discrepancy in the incorrect position along the y-axis of the tube end portion 31*b*. This enlargement of the width of gap A makes effective brazing more difficult. If gap A increases to a width greater than about 0.2 mm, it is difficult to provide enough brazing material to extend around the periphery of end portion 31*a*. If the width of gap A is much wider than about 0.2 mm (0.008 in), effective brazing becomes impossible. In other words, a tapered end portion allows for only small variations in the positioning of end portion within the hole of the tank due to the length of the tubes.

If straight end portions 26*b* are used, however, a wider variation in the length of tubes 26 may be allowed. Because the diameter of straight end portion 26*b* may be substantially uniform, the width of gap A is substantially constant as long as end portion 26*b* is disposed in hole 22*a* (23*a*).

SUMMARY OF THE INVENTION

It is an object of the present invention to provide a heat exchanger including heat transfer tubes with a structure which is easy to assemble and permits a wide variation in the length of the tubes and thus position of the end portions along the y-axis for effective brazing of the tubes to the tanks.

According to the present invention, a heat exchanger comprises a pair of tanks spaced from each other and a plurality of substantially parallel heat transfer tubes fluidly connected between the pair of tanks. Each of the plurality of heat transfer tubes has a central portion having a central diameter and end portions inserted into respective holes disposed in the pair of tanks. The end portions each have a base diameter which is less than the diameter of a central portion of each heat transfer tube. At least one of the end portions of each heat transfer tube comprises a straight portion and a tapered portion. The straight portion extends straight from the central portion and has a base diameter which is the maximum diameter of the end portion. The diameter of the central portion may be substantially uniform throughout. The tapered portion extends from the straight portion with a tapering diameter which gradually decreases from the base diameter to a tip diameter at the tip of the end portion.

In the heat exchanger according to the present invention, the tip of the end portion of each heat transfer tube is inserted into one of the holes of one of the tanks. Because the tip of the tapered portion has a diameter less than the diameter of the hole of the tank, the insertion may be performed with ease. After the tube is inserted, the straight portion of the end portion is positioned in the hole. Because the straight portion has a diameter which is the maximum diameter of the end portion, and because the maximum diameter is predetermined so that the width of the gap between the periphery of the straight portion and the inner edge of the hole is a suitable distance for brazing therebetween, e.g., less than or equal to about 0.2 mm (0.008 in), even if the position of the end portion varies slightly in length, i.e., along the y-axis, the gap may still be maintained at a width suitable for brazing or otherwise connecting. Therefore, insertion of end portions of the heat transfer tubes is easily performed and a wider variation in the length of tubes is permitted while still providing suitable brazing width between the tubes and the holes of the tanks.

Further objects, features, and advantages of the present invention will be understood from the detailed description of the preferred embodiments of the present invention with reference to the appropriate figures.

BRIEF DESCRIPTION OF THE DRAWINGS

Some preferred exemplary embodiments of the invention will now be described with reference to the appropriate figures, which are given by way of example only, and are not intended to limit the present invention.

DETAILED DESCRIPTION OF THE PREFERRED EMBODIMENTS

Figure 1:
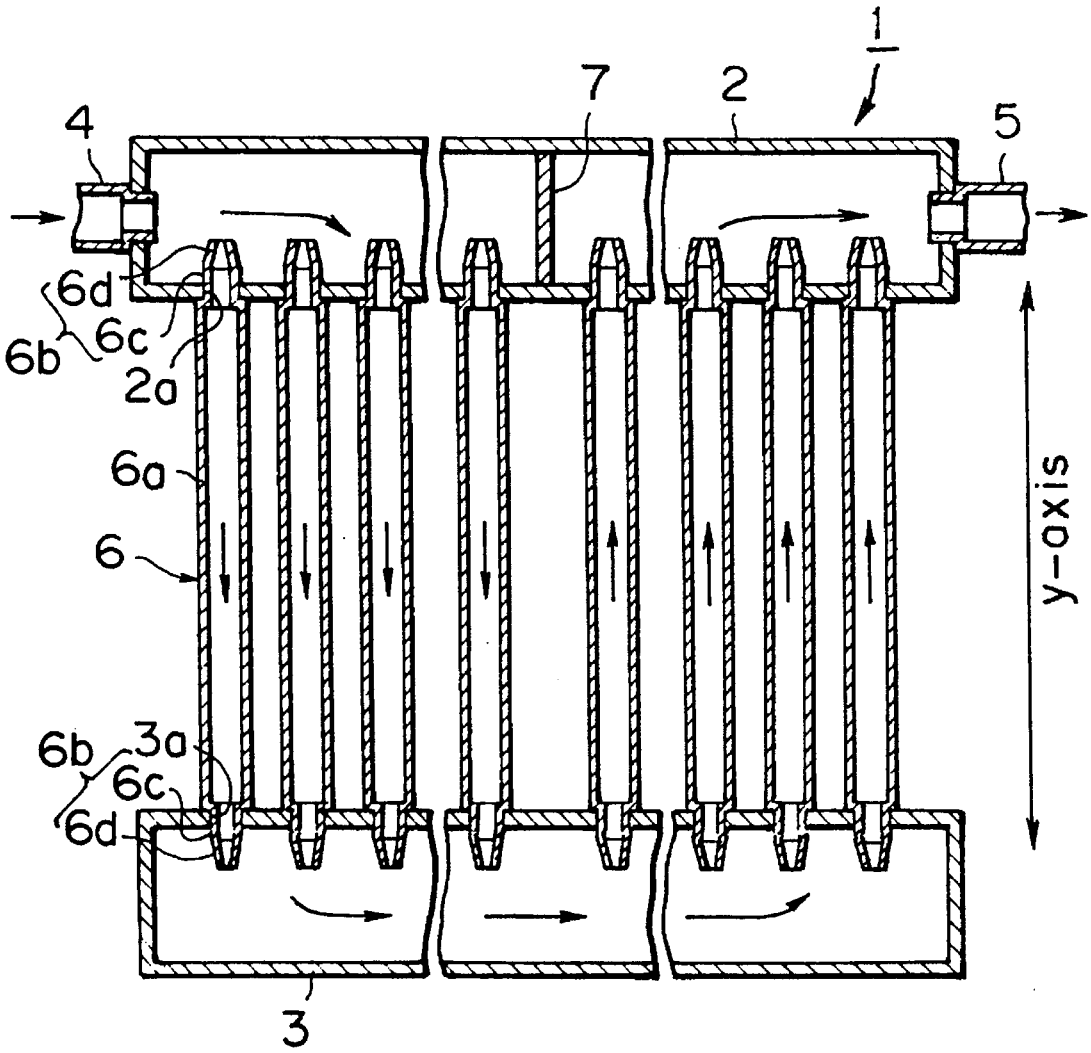
FIG. 1 is a vertical cross-sectional view of a heat exchanger according to a first embodiment of the present invention.
Figure 2:
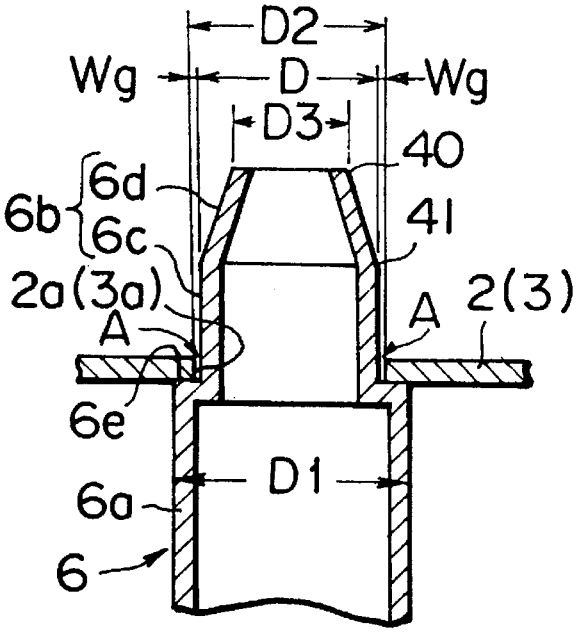
FIG. 2 is an enlarged, partial, vertical cross-sectional view of the heat exchanger depicted in FIG. 1.
Figure 3:
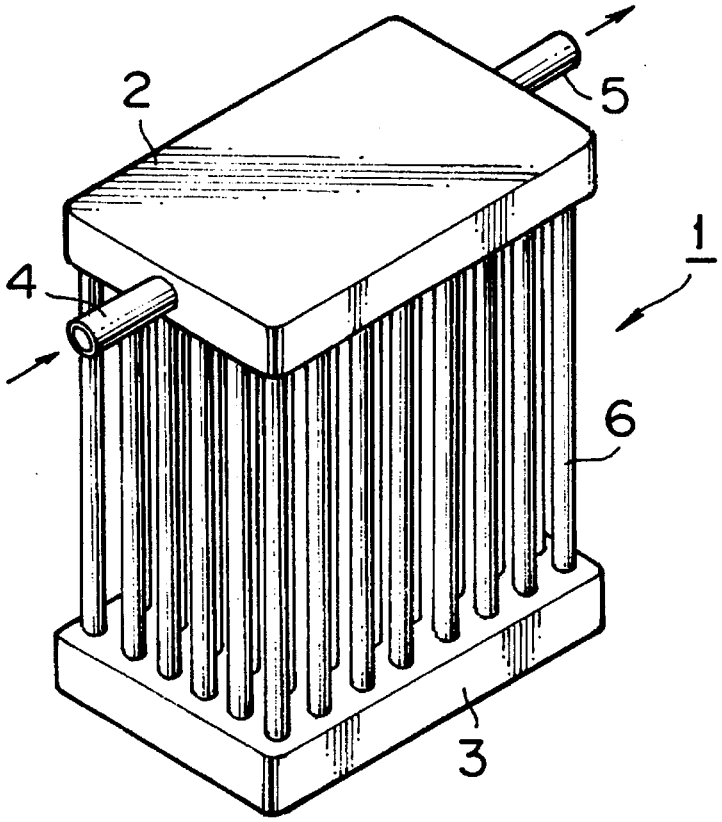
FIG. 3 is a perspective view of the heat exchanger depicted in FIG. 1.

Referring to FIGS. 1–3, a heat exchanger 1 is provided according to a first embodiment of the present invention. Heat exchanger 1 includes a pair of tanks 2 and 3. Inlet pipe 4 and outlet pipe 5 are connected to tank 2. A plurality of substantially parallel heat transfer tubes 6 (for example, refrigerant tubes) are fluidly connected between tanks 2 and 3. Heat transfer tubes 6 are arranged in columns and rows between tanks 2 and 3 of heat exchanger 1, as shown in FIG. 3. Each tube 6 has a central portion 6*a* and two end portions 6*b* having a maximum diameter less than the diameter of central portion 6*a*. The diameter of central portion 6*a* may be substantially uniform. A stepped portion 6*e* is formed between central portion 6*a* and each end portion 6*b*. Stepped portion 6*e* is substantially perpendicular to an axis through the diameter of both central portion 6*a* and a straight portion 6*c*. Central portion 6*a* and end portions 6*b* of each tube 6 each have circular cross-sections along the entire length of tube 6. End portions 6*b* are inserted into holes 2*a* and 3*a* defined on tanks 2 and 3, and fixed to the tanks by brazing. A partition 7 is provided in tank 2 at a central portion thereof. Holes 2*a* and 3*a* may have substantially equal diameters. A heat medium, or example, refrigerant, flows from inlet pipe 4 to outlet pipe 5 through the interior of tank 2, down heat transfer tubes 6, through the interior of tank 3, up heat transfer tubes 6, and through the interior of tank 2, as shown by arrows in FIG. 1. As the heat medium flows through tubes 6, heat is exchanged between the heat medium and the atmosphere or an air flow passing between tubes 6 via the walls of tubes 6.

FIG. 2 depicts the structure of connection between end portion 6*b* of heat transfer tubes 6 and tank 2 or 3. End portions 6*b* have a base diameter which is a maximum diameter D less than a central diameter D1 of central portion 6*a* of each heat transfer tube 6. In the embodiment of FIG. 2, both end portions 6*b* of each heat transfer tube 6 comprises a straight portion 6*c* and a tapered portion 6*d*. Straight portion 6*c* extends straight out from the end of central portion 6*a*, that is, from stepped portion 6*e*, and has a diameter which is equal to the maximum diameter D. Tapered portion 6*d* extends from the end of straight portion 6*c*, i.e., base 41 to tip 40 of tube 6 with a diameter gradually decreasing from the maximum diameter D at base 41 to a tip diameter D3 at tip 40.

In FIG. 2, end portion 6*b* is inserted into hole 2*a* (3*a*) defined on tank 2 (3), and straight portion 6*c* is positioned in hole 2*a* (3*a*). The maximum diameter D is predetermined, so that the width of gap A, Wg, between the periphery of straight portion 6*c* and the inner edge of hole 2*a* (3*a*), i.e., $Wg=(D2-D)\times 1/2$, where D2 is the hole diameter of hole 2*a* (3*a*), is a value suitable for brazing or otherwise connecting therebetween, for example, less than or equal to about 0.2 mm (0.008 in). Each tube 6 is fixed to tanks 2 and 3 by brazing mainly at the positions of both straight portions 6*c*.

In the first embodiment, end portion 6*b* of each heat transfer tube 6 is inserted into hole 2*a* (3*a*) of tank 2 (3) via tip 40 of tapered portion 6*d*. Because minimum diameter D3 at tip 40 of tapered portion 6*d* is less than the hole diameter D2 of hole 2*a* (3*a*), the insertion of the tube may be made with ease. After the tube is inserted, straight portion 6*c* is positioned in hole 2*a* (3*a*). Because straight portion 6*c* has a diameter equal to the maximum diameter D, even if stepped portion 6*e* does not abut tank 2 (3) due to a slight variation in the length of tube 6, gap A may still be maintained at a suitable width for brazing or otherwise connecting. Because the width of gap A is predetermined to a suitable value for brazing, for example, less than about 0.2 mm (0.008 in), effective brazing occurs. Specifically a brazing material may be provided to adequately extend over the periphery of straight portion 6*c* and the inner edge of hole 2*a* (3*a*) in gap A. As a result, effective brazing may be maintained. Thus, in this heat exchanger, insertion of end portions 6*b* is easy, and effective brazing between the tubes 6 and the holes 2*a* and 3*a* of tanks 2 and 3 may be achieved in the manufacturing process of the heat exchanger. In addition, effective brazing may be obtained even if slight variations in the y-axis position of end portions 6*b* occur. This provides further improvement and uniformity in the quality of the heat exchanger.

Figure 4:
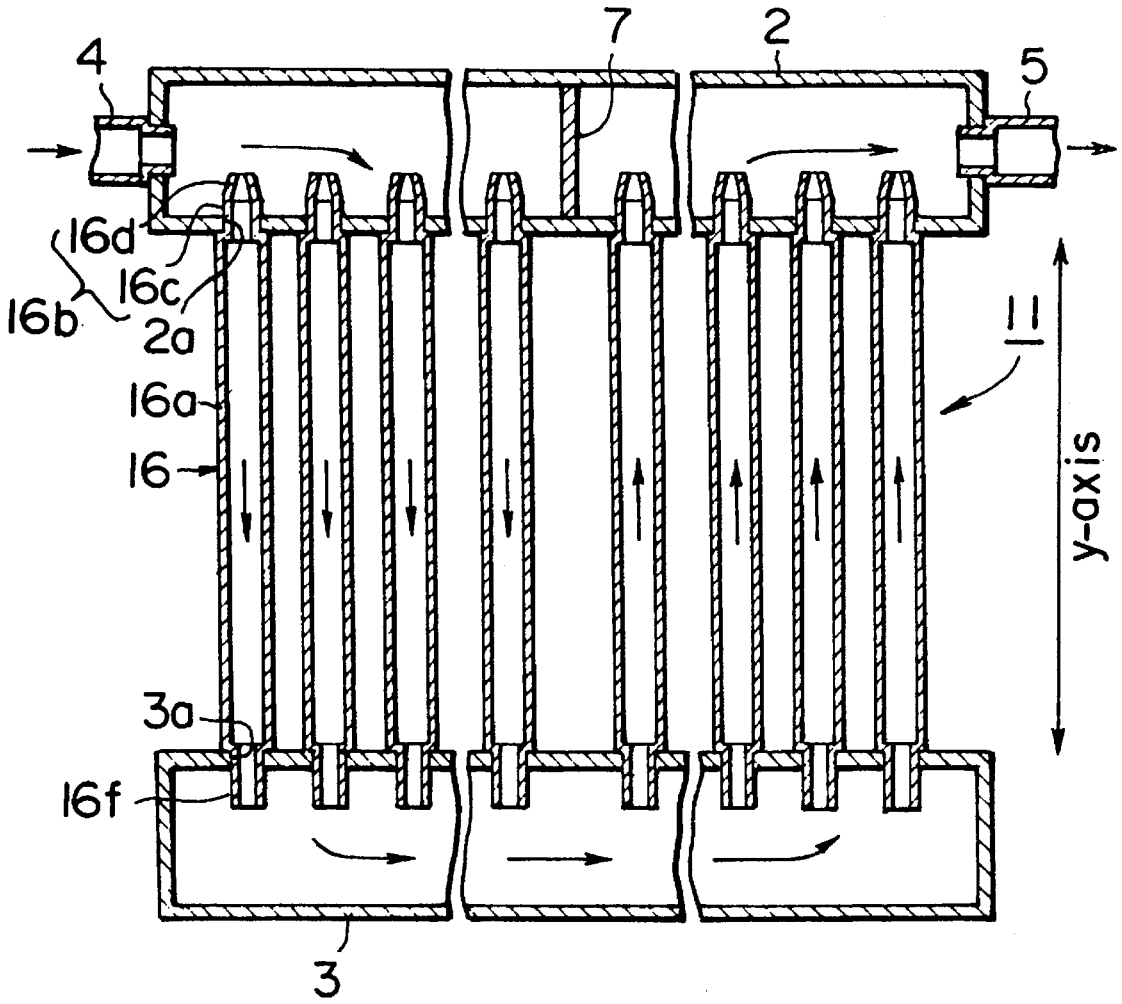
FIG. 4 is a vertical cross-sectional view of a heat exchanger according to a second embodiment of the present invention.
Figure 5:
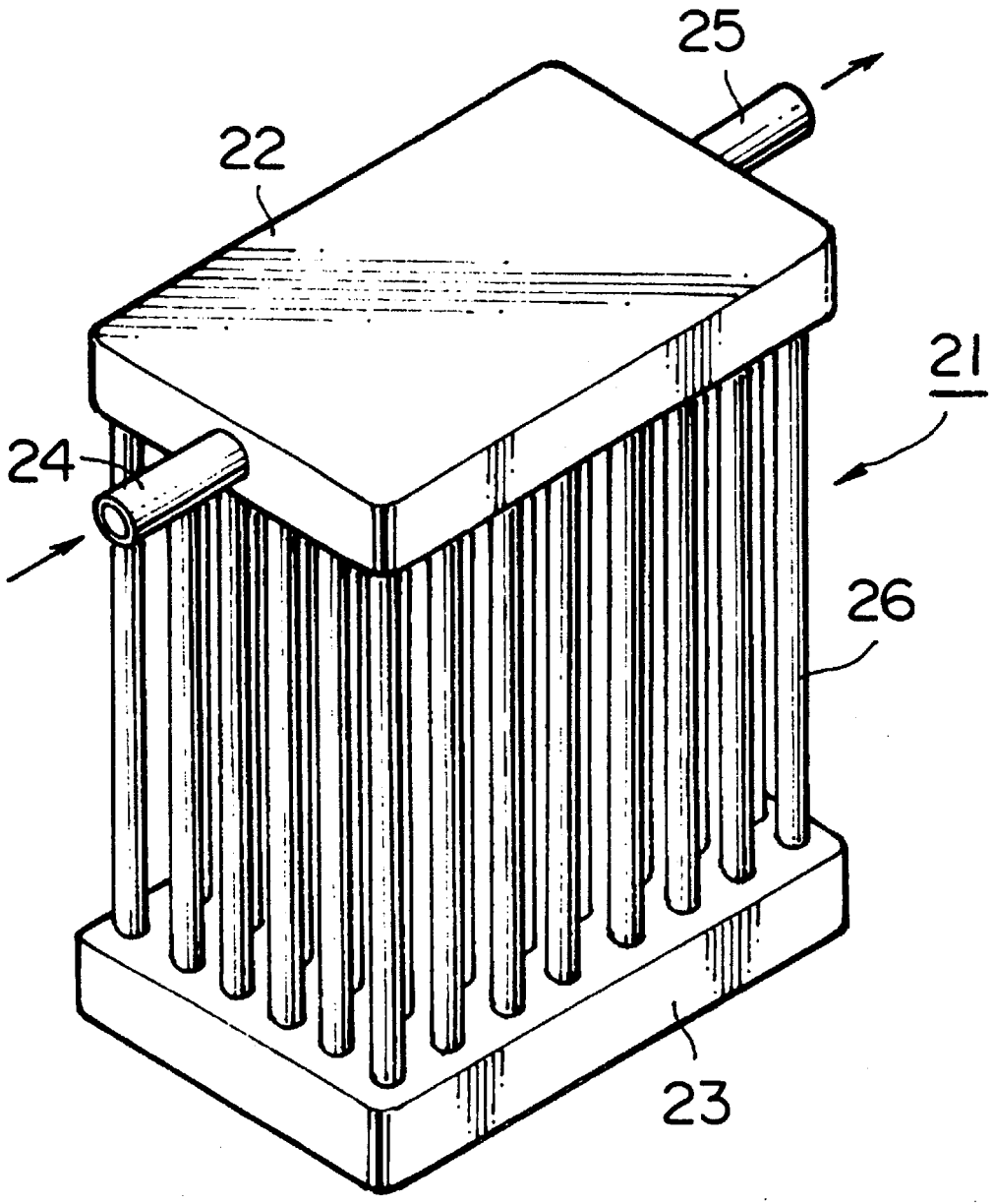
FIG. 5 PRIOR ART
FIG. 5 is a perspective view of a known heat exchanger.
Figure 6:
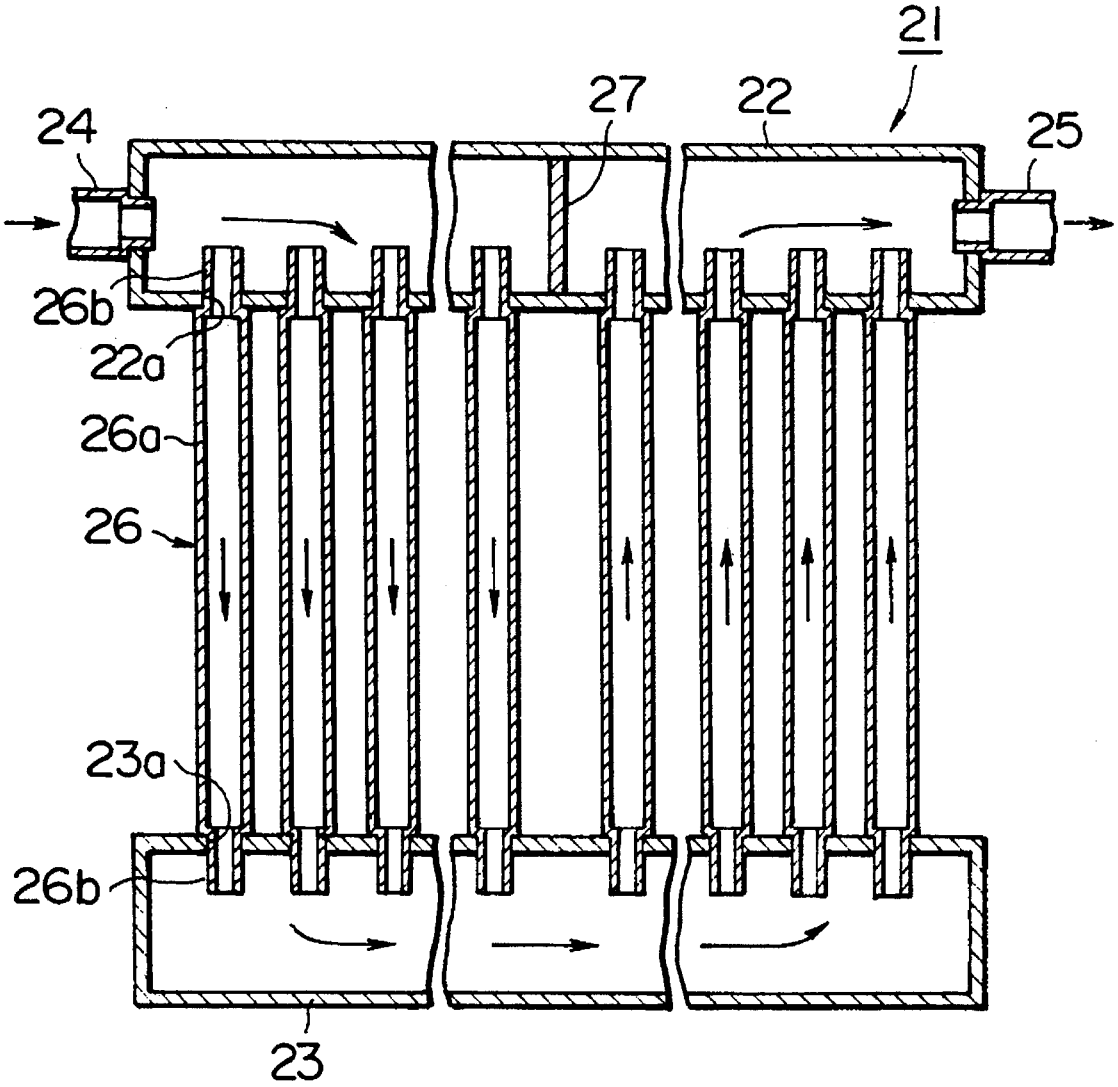
FIG. 6 PRIOR ART
FIG. 6 is a vertical cross-sectional view of the heat exchanger depicted in FIG. 5.
Figure 7:
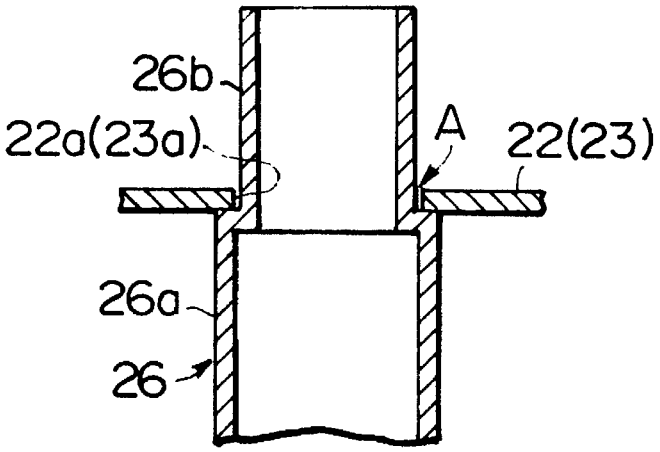
FIG. 7 PRIOR ART
FIG. 7 is an enlarged, partial, vertical cross-sectional view of the heat exchanger depicted in FIG. 5.
Figure 8:
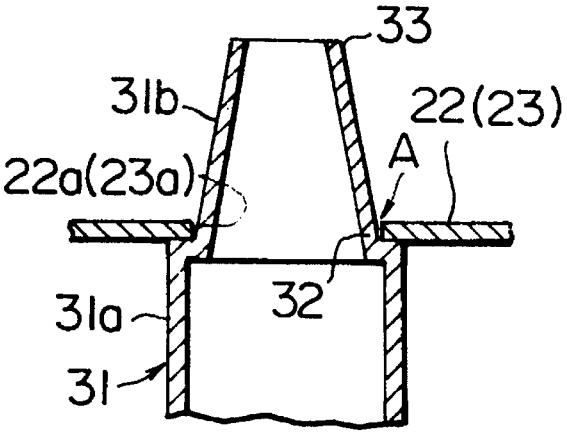
FIG. 8 PRIOR ART
FIG. 8 is a partial vertical cross-sectional view of another conventional heat exchanger.
Figure 9:
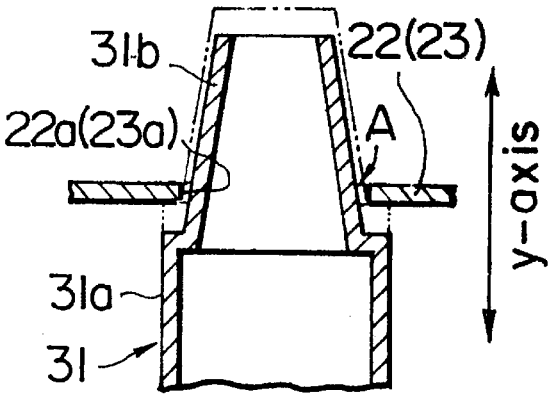
FIG. 9 PRIOR ART
FIG. 9 is a vertical cross-sectional view of the portion depicted in FIG. 8, showing a positioning of a tube.

FIG. 4 depicts a heat exchanger according to a second embodiment of the present invention. In this embodiment, straight portion 16*c* and tapered portion 16*d* are formed only on one end portion 16*b* of each heat transfer tube 16. The other end portion 16*f* of each tube 16 is formed merely as a straight pipe. In the manufacturing of a heat exchanger 11, end portions 16*f* are inserted into holes 3*a* of tank 3. Next, end portions 16*b* are inserted into holes 2*a* of tank 2. When end portions 16*f* are inserted into holes 3*a*, the end portions are easily inserted even if the end portions are straight. Nevertheless, if end portions 16*b* are also straight, the insertion thereof into holes 2*a* is difficult as aforementioned in the explanation of the related art. In this embodiment, because each end portion 16*b* has straight portion 16*c* and tapered portion 16*d*, an easy insertion of each tube 16 may be achieved by tapered portion 16*d*, and excellent brazing between tube 16 and tank 2 may be ensured by straight portion 16*c*. Thus, even if straight portion 16*c* and tapered portion 16*d* are formed only on one end portion 16*b* of each heat transfer tube 16, effective brazing and easy manufacture are still obtained.

Although several preferred embodiments of the present invention have been described in detail herein, the invention is not limited thereto. It will be appreciated by those skilled in the art that various modifications may be made without materially departing from the novel and advantageous teachings of the invention. Accordingly, the embodiments disclosed herein are by way of example. It is to be understood that the scope of the invention is not to be limited thereby, but is to be determined by the claims which follow.

What is claimed is:

1. A heat exchanger comprising:

a pair of tanks spaced from each other; and a plurality of heat transfer tubes each having a wall with a uniform thickness over an entire length thereof, said tubes fluidly connecting said pair of tanks, each heat transfer tube comprising:

a central portion having a substantially uniform central diameter; and a first end portion integral with said central portion and comprising a first straight portion and a first tapered portion, said first straight portion having a first base diameter less than the central diameter, said first tapered portion comprising a first base and a first tip and having a first tapering diameter which decreases from the first base diameter at said first base to a first tip diameter at said first tip.

2. The heat exchanger of claim 1, wherein said plurality of heat transfer tubes are arranged in columns and rows between said tanks of said heat exchanger.

3. The heat exchanger of claim 1, wherein each of said tubes further comprises a stepped portion formed between said straight portion and said central portion, said stepped portion being substantially perpendicular to said straight portion and said central portion.

4. The heat exchanger of claim 1, wherein each said heat transfer tube further comprises a second end portion integral with said central portion and comprising a second straight portion having a second base diameter less than the central diameter and a second tapered portion, said second tapered portion comprising a second base and a second tip and having a second tapering diameter which decreases from the second base diameter at said second base to a second tip diameter at said second tip.

5. The heat exchanger of claim 4, wherein each of said end portions of said heat transfer tubes have circular cross-sections.

6. The heat exchanger of claim 4, wherein each of said first end portions is connected to a first tank of said pair of tanks and each of said second end portions are connected to a second tank of said pair of tanks.

7. The heat exchanger of claim 1, wherein said end portions of each heat transfer tube are fixed to said tanks by brazing.

8. The heat exchanger of claim 7, wherein the straight portion is positioned in a hole formed in one of the tanks to create a gap between the straight portion and an inner edge of the hole, and wherein a brazing material is disposed within the gap so that a width of the gap is maintained during brazing to effect a secure brazing connection between the heat transfer tube and the tank.

9. The heat exchanger of claim 1, wherein each of said heat transfer tubes has a circular cross-section.

10. The heat exchanger of claim 1, wherein said straight portion and an inner edge of said holes define a gap having a width less than or equal to about 0.2 mm (0.008 in).

11. The heat exchanger of claim 1, wherein said heat transfer tubes are substantially parallel.

12. The heat exchanger of claim 1, wherein said tanks have a plurality of holes disposed therein and each of said end portions of said heat transfer tubes is disposed in one of said holes.

13. The heat exchanger of claim 12, wherein each said heat transfer tube further comprises a second end portion integral with said central portion and comprising a second straight portion having a second base diameter less than the central diameter and each of said straight portions is positioned in one of said holes and brazed to said tank.

14. The heat exchanger of claim 12, wherein the straight portion is positioned in the hole to create a gap between the straight portion and an inner edge of the hole, and wherein a brazing material is disposed within the gap so that a width of the gap is maintained during brazing to effect a secure brazing connection between the heat transfer tube and the tank.

15. A heat exchanger comprising:

a pair of tanks spaced from each other and having a plurality of holes disposed therein, each hole having a hole diameter; and a plurality of substantially parallel heat transfer tubes each having a wall with a uniform thickness over an entire length thereof, said tubes fluidly connecting said pair of tanks, each heat transfer tube comprising:

a central portion having a substantially uniform central diameter; and two end portions each being integral with said central portion and comprising a straight portion and a tapered portion, said straight portion having a base diameter less than the substantially uniform central diameter and slightly less than the hole diameter, said tapered portion comprising a base and a tip and having a tapering diameter which decreases from the base diameter at said base to a tip diameter at said tip, wherein each end portion is inserted into one of said holes and brazed to one of said tanks.

16. A method of assembling a heat exchanger comprising a pair of tanks spaced from each other and having a plurality of holes disposed therein, said method comprising the steps of:

providing a plurality of heat transfer tubes, each of said heat transfer tubes comprising a central portion having a central diameter, a first end portion comprising a first straight portion and a first tapered portion, said first straight portion having a first base diameter less than the central diameter, said first tapered portion comprising a first base and a first tip and having a first tapering diameter which decreases from the first base diameter at said first base to a first tip diameter at said first tip, and a second end portion comprising a second straight portion, each of said tubes having a wall with a uniform thickness over an entire length thereof;

inserting said second end portions of said heat transfer tubes into holes in a first tank of said pair of tanks;

positioning said straight portions of said second end portions in said holes of said first tank;

inserting said first end portions of said heat transfer tubes into holes in a second tank of said pair of tanks; and positioning said straight portions of said first end portions in said holes of said second tank.

17. The method of claim 16, wherein said second end portions of said plurality of heat transfer tubes further comprise a second tapered portion, said second tapered portion comprising a second base and a second tip and having a second tapering diameter which decreases from the second base diameter at said second base to a second tip diameter at said second tip.

18. The method of claim 16, wherein a difference between the first and second base diameters and a hole diameter of an inner edge of each hole is sufficiently small to permit effective brazing.

19. The method of claim 16, wherein the difference is less than about 0.2 mm (0.008 in).

20. The method of claim 16 further comprising the steps of:

inserting a brazing material in a gap formed between said straight portion of said heat transfer tubes and an inner edge of said holes of said tank; and brazing said heat transfer tubes to said tank using said brazing material in said gap.

21. The method of claim 20, wherein a width of the gap is maintained during brazing to effect a secure brazing connection between the heat transfer tubes and the tank.

22. The method of claim 16, wherein each of said heat transfer tubes have a circular cross-section.

* * * * *